US009070354B2

(12) United States Patent
Tseng

(10) Patent No.: US 9,070,354 B2
(45) Date of Patent: Jun. 30, 2015

(54) ACOUSTIC WAVE GENERATOR EMPLOYING FLUID INJECTOR

(76) Inventor: Ho Ping Tseng, San Jose, CA (US)

( * ) Notice: Subject to any disclaimer, the term of this patent is extended or adjusted under 35 U.S.C. 154(b) by 485 days.

(21) Appl. No.: 13/598,061

(22) Filed: Aug. 29, 2012

(65) Prior Publication Data

US 2014/0064036 A1 Mar. 6, 2014

(51) Int. Cl.
*G10K 9/08* (2006.01)
*G10K 7/00* (2006.01)

(52) U.S. Cl.
CPC ..... *G10K 7/00* (2013.01)

(58) Field of Classification Search
CPC ..... G10K 7/00
USPC ..... 367/144, 190
See application file for complete search history.

(56) References Cited

U.S. PATENT DOCUMENTS

| | | | | |
|---|---|---|---|---|
| 3,064,619 | A | 11/1962 | Fortman | |
| 4,428,346 | A | 1/1984 | Hoshi | |
| 4,598,660 | A * | 7/1986 | Konzak | 116/22 A |
| 4,735,281 | A * | 4/1988 | Pascouet | 367/144 |
| 6,148,839 | A | 11/2000 | Gonske | |
| 6,457,654 | B1 | 10/2002 | Glezer et al. | |
| 2010/0302902 | A1* | 12/2010 | Nance et al. | 367/144 |
| 2014/0064036 | A1* | 3/2014 | Tseng | 367/190 |

OTHER PUBLICATIONS

Search Report from corresponding PCT application; PCT/US2013/055665; mailed Jan. 10, 2014; 7 pages.
Dauphinee, T.M., "Acoustic Air Pump"; The Review of Scientific Instruments, vol. 28, No. 6, Jun. 1957; one page.
Olsson, Anders et al., "A valve-less planar fluid pump with two pump chambers"; Elsevier, Sensors and Actuators; A 46-47; 1995; pp. 549-556.
Glendinning, A.G. et al.; "Experiments on a Compressed Air Loudspeaker"; Journal of Sound and Vibration, 138(3), 1990; pp. 479-491.
Fiala, Walter T. et al., "Electropneumatic Acoustic Generator"; LTV Research Center, Western Division, Ling-Temco-Vought, Inc., Anaheim, California; Received Aug. 24, 1965; pp. 956-964.
Gilmore, Dan, "What's louder than loud? Auxetophone"; Auxetophone Technical Comments; www.angelfire.com/nc3/talkingmachines/auxetophone; Apr. 2, 2012; one page.

* cited by examiner

*Primary Examiner* — Daniel Pihulic
(74) *Attorney, Agent, or Firm* — Michael P. Fortkort, Esq.; Michael P Fortkort PC

(57) ABSTRACT

To reproduce sound in an extremely compact size, fluid injectors are used that can generate fluid flow sufficient to create a desired acoustic pressure wave, but which fluid flow operates in a manner that is decoupled from the desired acoustic pressure wave. Fluid flow within the fluid injectors needed to generate the desired acoustic pressure wave need not be directly proportional to the frequencies of the desired acoustic pressure wave. The fluid injector has a control input capable of altering fluid flow relative to a received control signal, which is generated by a controller in response to an electrical signal. The fluid injector produces fluid flow outward and inward in response to the control signal, thereby creating an acoustic wave proportional to the electrical signal. The devices herein may employ valves or not. Synthetic jets may also be used.

11 Claims, 12 Drawing Sheets

Prior Art

90

100

ACOUSTIC WAVE GENERATOR EMPLOYING FLUID INJECTOR

BACKGROUND

The present invention relates generally to acoustical wave generators, and more particularly to an acoustic wave generator for producing audible sound waves.

An acoustic wave is formed when fluid pressure, be it for gas (air or other gas) or liquid, is made to vary in time and space. This is usually effected through a device which vibrates to cause this pressure wave. In air, this is typically done with a vibrating diaphragm in a device known as a loudspeaker, which alternately compresses and rarefies the air contacting the diaphragm as it vibrates.

An exemplary prior art loudspeaker is depicted in FIG. 1. In this device, the diaphragm vibrates in a range typically between 20 Hz to 20,000 Hz to create audible sound and at even higher frequencies to produce inaudible ultrasound. An applied current through the voice coil causes a deflection proportional to the current through magnetic interaction between the voice coil and magnet. As the diaphragm is caused to deflect to the right, air is compressed; as it is caused to deflect to the left, air is rarefied. This creates a pressure wave travelling away from the diaphragm which we perceive as sound.

The principle works similarly for other media, such as liquid or even solids. Also, actuation is not limited to magnetic means as shown here. For example, electrostatic or piezoelectric forces are routinely used for the same purpose. Note that a loudspeaker is a zero net mass flux device, as it does not cause a net positive mass flow of the surrounding medium.

While this method of sound reproduction is effective and widely used, its ability to deliver acoustic power remains dependent on the size of the diaphragm as well as the amount or speed of diaphragm deflection possible. These dependencies become a problem when higher acoustic power is desired per given size. This is the case when miniaturization demands delivery of adequate power at increasingly smaller device sizes such as is the case with cell phones and laptop computers. In particular, such dependencies limit the possible miniaturization of speakers.

The present invention is therefore directed to the problem of developing a method and apparatus for reproducing sound with sufficient acoustic power for consumer electronic applications but in an extremely compact size.

SUMMARY OF THE INVENTION

The present invention solves these and other problems with the embodiments of an acoustic wave generator below.

According to one aspect of the present invention, an apparatus for producing an acoustic wave includes a fluid injector to generate the acoustic wave in response to a signal representative of a desired acoustic wave. The apparatus includes a controller directly modulating the fluid injector based on an electrical signal representing the desired acoustic wave. More advantageously, the fluid injector used in the embodiments of the present invention can operate at frequencies that do not have a one-to-one relationship to the frequencies of the output acoustic wave. In other words, the internal movement (e.g., diaphragm displacement or vibration) or pumping action can be designed to operate at a much higher frequency than the frequency range of the output acoustic wave, thereby enabling smaller speaker sizes for a given acoustic power. For example, the fluid injector can operate in the ultrasonic range while outputting an acoustic wave in the audible range. As a result, the present invention can be micro-machined.

According to another aspect of the present invention, an apparatus for producing an acoustic wave includes a fluid injector to produce fluid flow, a valve coupled to the fluid injector having a control input and a controller coupled to the control input modulating the valve based on an electrical signal representing the desired acoustic wave.

In certain embodiments, the fluid injector can include an enclosure with a cavity and a diaphragm disposed inside the enclosure. The diaphragm vibrates at a predetermined frequency. While the diaphragm vibrates at a predetermined frequency, fluid injector can operate in the ultrasonic range. The fluid injector can be micro-machined. One or more fluid injectors can be used.

According to another aspect of the present invention, a method for generating an acoustic wave includes receiving a signal representative of a desired acoustic wave and generating the acoustic wave using a fluid injector in response to the received signal by modulating the fluid with the signal representative of the desired acoustic wave. As in the above exemplary apparatus, in this exemplary method the fluid injector can operate at a different frequency, such as its resonant frequency, than a frequency included in the output acoustic wave.

One exemplary embodiment of the present invention operates using one or more fluid injectors that can generate fluid flow sufficient to create the desired acoustic pressure wave, but which fluid flow operates in a manner that is decoupled from the desired acoustic pressure wave. In other words, the internal operating parameters of the fluid injector are not directly dependent on the properties of the desired acoustic pressure wave.

In contrast to traditional acoustic transducers, the internal motion of the device needed to generate the desired acoustic pressure wave need not be directly proportional to the frequencies of the desired acoustic pressure wave. These features and principles are embodied in the various embodiments set forth below.

According to one exemplary embodiment of the present invention, an apparatus for producing an acoustic wave includes two fluid injectors. The first fluid injector produces fluid flow in a direction outward from the device, whereas the second fluid injector produces fluid flow in a direction inward to the device. Two valves are included in the apparatus. Each valve has a control input to receive a control signal. The first valve is coupled to the first injector and the second valve is coupled to the second injector. A controller is used to generate a control signal. The controller is coupled to the control inputs of the two valves. The controller receives an electrical signal and activates the two valves via the control inputs based on the electrical signal to control a fluid flow out of the first injector or into the second injector, thereby creating an acoustic wave representative of the electrical signal.

According to another exemplary embodiment of the present invention, an apparatus for producing an acoustic wave uses one fluid injector to produce fluid flow outward from the apparatus. A valve with a control input is coupled to the fluid injector. A controller generates a control signal and applies the control signal to the control input of the valve. The controller receives an electrical signal and activates the valve via the control input based on the electrical signal to modulate fluid flow out of the fluid injector, thereby creating an acoustic wave proportional to the electrical signal.

According to yet another exemplary embodiment of the present invention, an apparatus for producing an acoustic wave uses two fluid injectors but no valves. One fluid injector produces fluid flow outward from the apparatus, whereas the other fluid injector produces fluid flow inward to the apparatus. The injectors have a control input capable of altering a fluid flow relative to a received control signal. A controller generates a control signal that is applied to the control inputs of the two injectors. The controller receives an electrical signal and controls a fluid flow out of the first injector or into the second injector, thereby creating an acoustic wave representative of the electrical signal.

According to still another exemplary embodiment of the present invention, an apparatus for producing an acoustic wave uses one fluid injector but no valves. The fluid injector produces fluid flow outward from the apparatus. The fluid injector has a control input capable of altering fluid flow relative to a received control signal. A controller generates a control signal that is applied to the control input. The controller receives an electrical signal and modulates fluid flow out of the fluid injector based on the electrical signal, thereby creating an acoustic wave proportional to the electrical signal.

In various embodiments herein, the control signal may be an analog signal, in which case fluid flow out of or into the fluid injector remains proportional to the analog signal.

Alternatively, in various embodiments herein, the control signal may be a digital signal, in which case fluid flow out of or into the fluid injector remains at one or more discrete levels as determined by the digital signal. The one or more discrete levels can be zero, one or more intermediate levels, and a maximum level.

According to still another exemplary embodiment of the present invention, an apparatus for producing an acoustic wave uses an air pump. The air pump has an input and an output. A first cavity has an input coupled to an output of the air pump. A second cavity has an output coupled to the input of the air pump. The air pump pumps air from the second cavity to the first cavity. A first valve has an input coupled to an output of the first cavity and a control input to which is applied a control signal. A second valve has an output coupled to the input of the second cavity. The second valve also has a control input to which is applied the control signal. A controller generates the control signal representative of a received electrical signal. The controller applies the control signal to the control inputs of the first and second valves, thereby creating an acoustic wave representative of the electrical signal based on air output from the first valve and air input to the second valve.

According to yet another exemplary embodiment of the present invention, an apparatus for producing an acoustic wave includes two diaphragm based pumps. A main cavity is used to store a repository of air. Each pump has a cavity that houses a diaphragm. The first pump has a diffuser with an input coupled to the output of the main cavity and an output coupled to the input of the first pump's cavity. The first pump has a nozzle with an input coupled to the output of the first pump's cavity, which nozzle outputs air. Each pump has a control input to which is applied a control signal to control a movement of the pump's diaphragm. Air flow through the second pump is in the opposite direction to the air flow through the first pump. So, the second pump has a diffuser with an air input and with an output coupled to the input of the second pump's cavity. The second pump has a nozzle with an input coupled to the output of the second pump's cavity, and an output coupled to the input of the main cavity. A controller receives an electrical signal and generates the control signal, which is representative of the electrical signal. The control signal is applied to the control inputs of the two pumps to create an acoustic wave representative of the electrical signal based on air output from the first pump's nozzle caused by movement of the first pump's diaphragm and air input to the second pump's diffuser caused by movement of the second pump's diaphragm.

According to still another exemplary embodiment of the present invention, an apparatus for producing an acoustic wave employs a synthetic jet. The synthetic jet includes an enclosure with a cavity and an orifice. The synthetic jet has a control input to which is applied a control signal, which controls movement of a diaphragm disposed inside the enclosure. A controller receives an electrical signal and generates the control signal, which is representative of the electrical signal. The controller applies the control signal to the control input of the synthetic jet to create an acoustic wave representative of the electrical signal. The diaphragm forces fluid into and out of the cavity as the diaphragm vibrates under control of the control signal. Under certain values of the control signal, the diaphragm expels fluid at a sufficient distance from the orifice to create a net positive air flow through an entrainment process, thereby creating the acoustic wave.

In the above exemplary embodiments, a sensor or microphone can be used to help improve fidelity of the sound. A sensor or microphone coupled to the controller receives the produced acoustic wave and outputs a feedback signal representative of the acoustic wave to the controller. In turn, the controller modifies the control signal in accordance with the feedback signal to linearize the acoustic wave in relation to the electrical signal.

DETAILED DESCRIPTION

It is worthy to note that any reference herein to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment or all embodiments.

Figure 2:
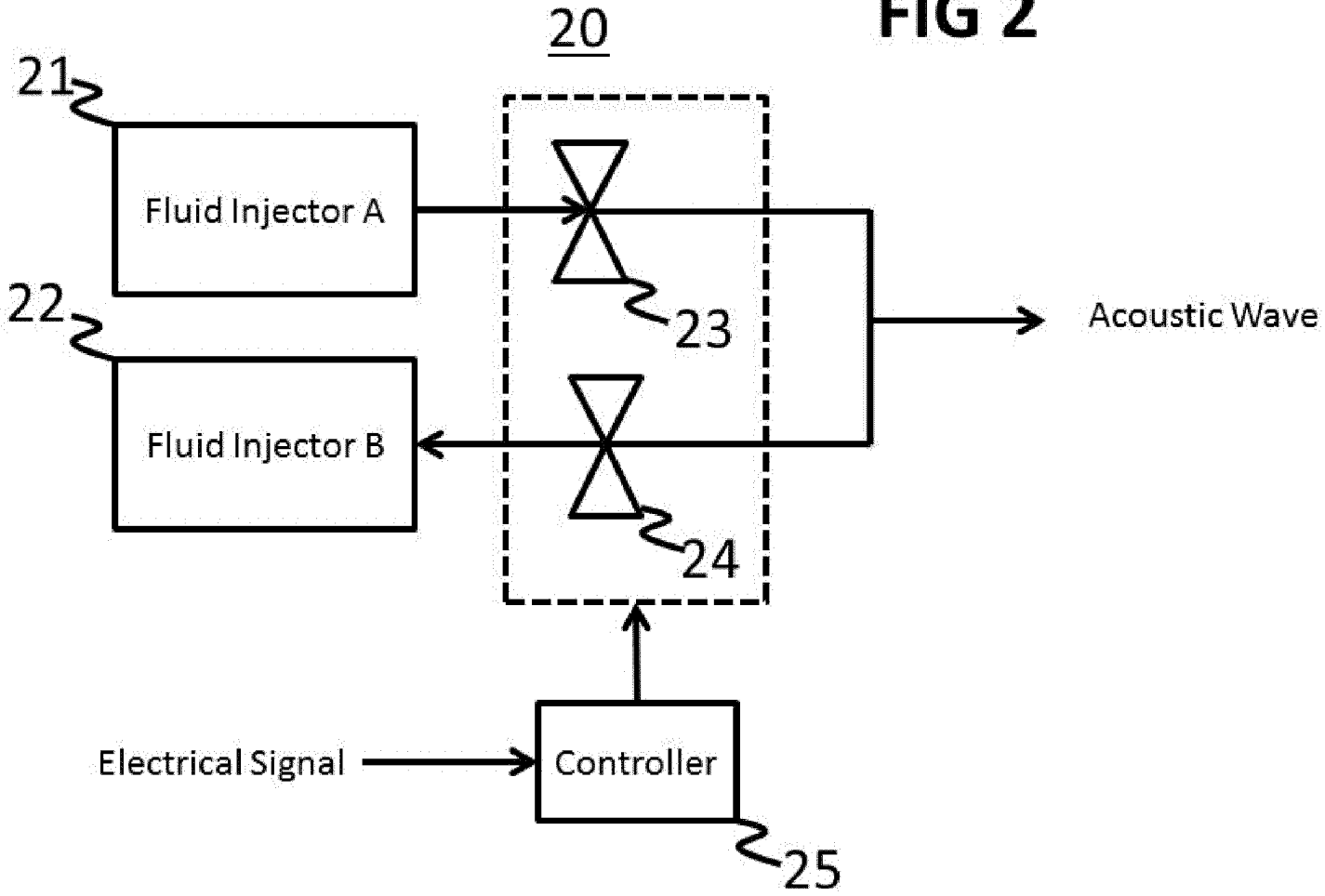
FIG. 2 depicts an exemplary embodiment of a method for producing an acoustic wave according to one aspect of the present invention.

According to one aspect of the present invention, an apparatus 20 for producing an acoustic wave is shown in FIG. 2, which is a simplified diagram for such an apparatus. Devices 21 and 22 are fluid injectors (e.g., pumps, synthetic jets, pistons, turbines/propellers, etc.) capable of producing fluid flow in the directions shown by the arrows.

The present invention provides for the use of fluid injectors to create controllable acoustic waves for reproducing sound from traditional information bearing electrical signals used in audio applications. In particular, by employing micro-machined fluid injectors, the present invention provides a highly miniaturized audio speaker that finds applications in any device, including a consumer electronic device, in which size is important. Of course, reducing the size of the speaker enables reduction of the overall device.

Thus, very small speakers suitable for portable phones, portable computing devices, handheld devices, clothing, wearable gear, watches, etc. are now possible.

It should be noted that any fluid injector may be used in this apparatus 20 without departing from the scope of the present invention.

Valves

Valves 23, 24 are activated by controller 25 to control the fluid flow out of fluid injector 21 or into fluid injector 22, respectively, based on an electrical signal input into controller 25. Valves 23, 24 can be any valve capable of turning on and off (or otherwise increasing/reducing) the fluid flow out of or into the fluid injectors 21, 22.

Any fluid valves will suffice in apparatus 20 without departing from the scope of the present invention. For example, a micro-machined valve may be suitable in applications where the overall device is micro-machined. U.S. Pat. Nos. 6,237,619 and 6,715,733 disclose suitable micro-machined valves.

Controller

To effect compression, controller 25 activates valve 23. To effect rarefaction, controller 25 activates valve 24. By suitable control of valves 23, 24 a sound wave representing the input electrical signal can be produced. Controller 25 can be a processor or an electrical circuit that receives the electrical input signal and outputs a control signal that adjusts the valves 23, 24 based on the amplitude of the input signal. By suitably opening and closing the valves 23, 24, controller 25 can create a time varying control signal that depends on the input electrical signal, thereby creating an acoustic wave that in turn depends on the input electrical signal. Thus, the acoustic wave will vary in accordance with the input electrical signal.

This novel embodiment according to the present invention for producing a sound wave representative of an electrical signal operates without requiring the functional elements to be proportional to the sound wave that is desired to be produced; hence the apparatus 20 can be made quite small and in fact can be made using semiconductor or other micro-machining techniques. Embodiments herein can range as small as ten centimeters to less than a millimeter.

Figure 3:
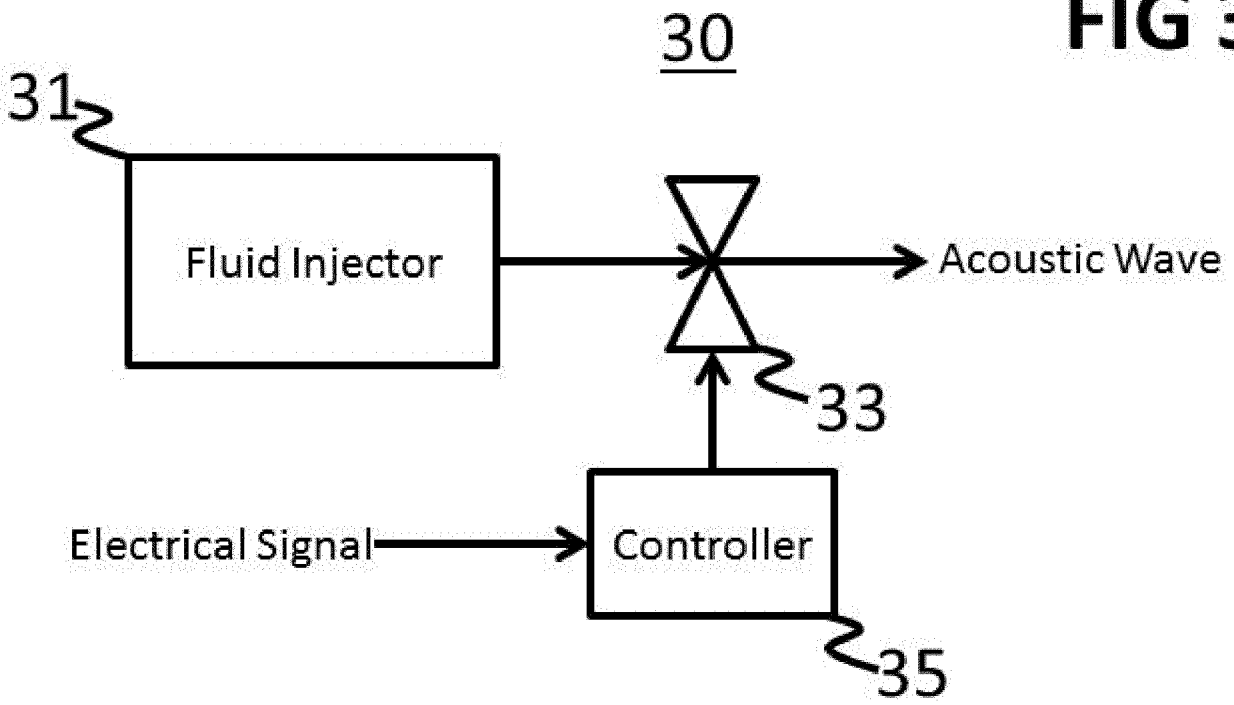
FIG. 3 depicts another exemplary embodiment of a method for producing an acoustic wave with only one pump according to another aspect of the present invention.

Turning to FIG. 3, shown therein is another exemplary embodiment 30 of the present invention. Since humans perceive sound waves based on pressure differences rather than absolute pressure, one can omit fluid injector 22 and valve 24 in apparatus 20 resulting in apparatus 30, as shown in FIG. 3. In apparatus 30, a sound wave proportional to the electrical signal is generated by modulating the fluid flow out of fluid injector 31 by controlling valve 33 with controller 35. As in apparatus 20, fluid injector 31 is capable of producing fluid flow in the direction shown by the arrow. Any fluid injector should suffice in this embodiment.

Figure 4:
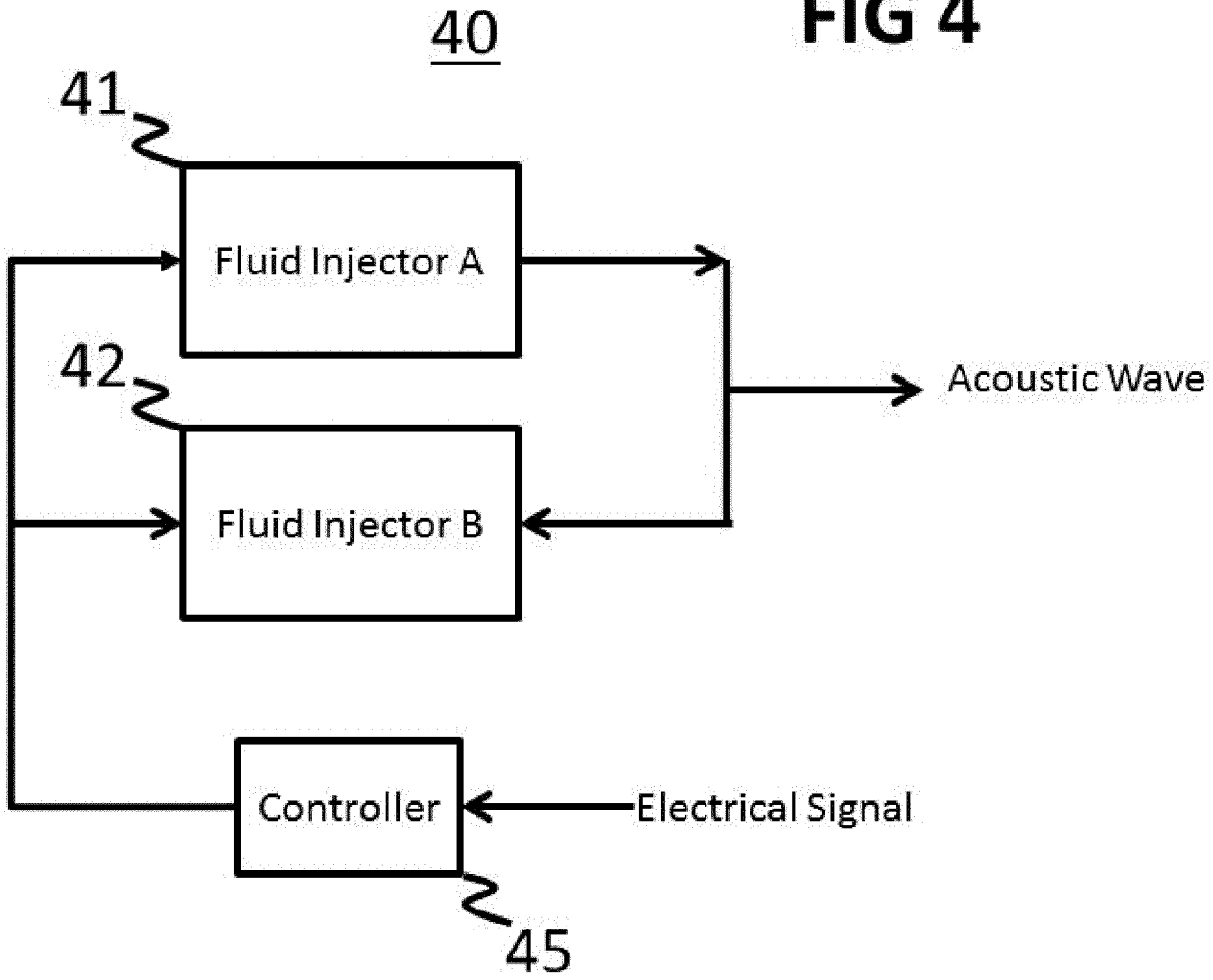
FIG. 4 depicts yet another exemplary embodiment of a method for producing an acoustic wave in which the pumps are controlled directly according to yet another aspect of the present invention.
Figure 5:
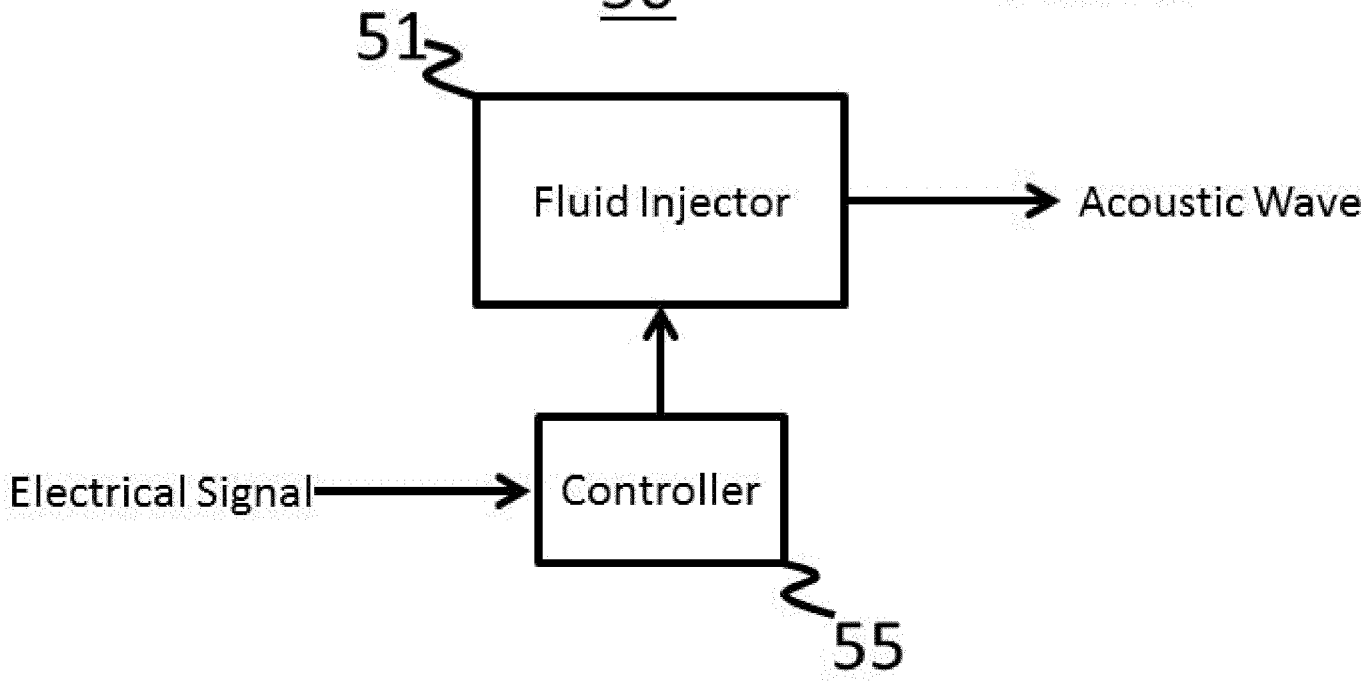
FIG. 5 depicts an exemplary embodiment of an apparatus for producing an acoustic wave according to still another aspect of the present invention.
Figure 7:
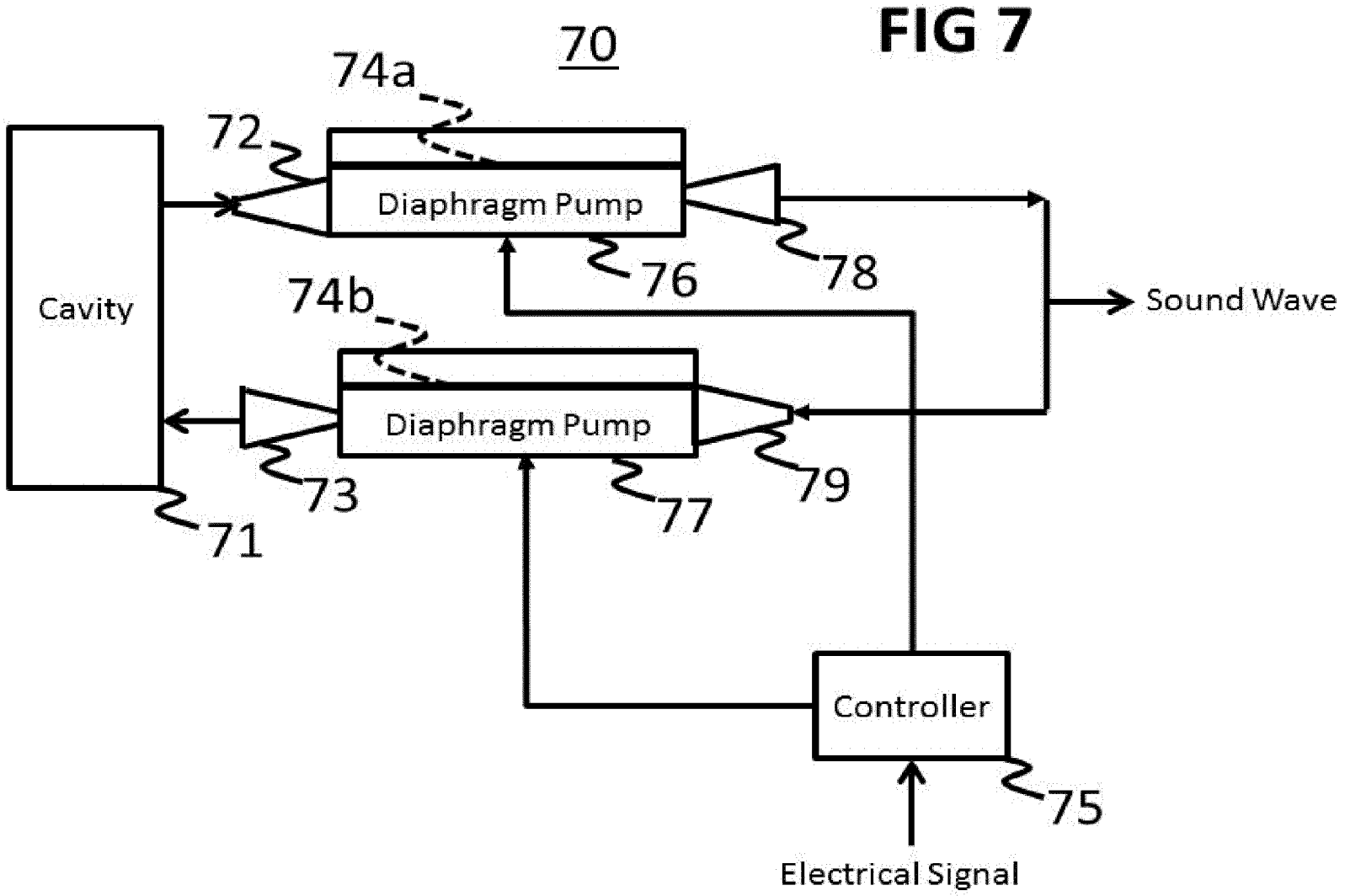
FIG. 7 depicts yet another exemplary embodiment of an apparatus for producing an acoustic wave according to yet another aspect of the present invention.
Figure 8:
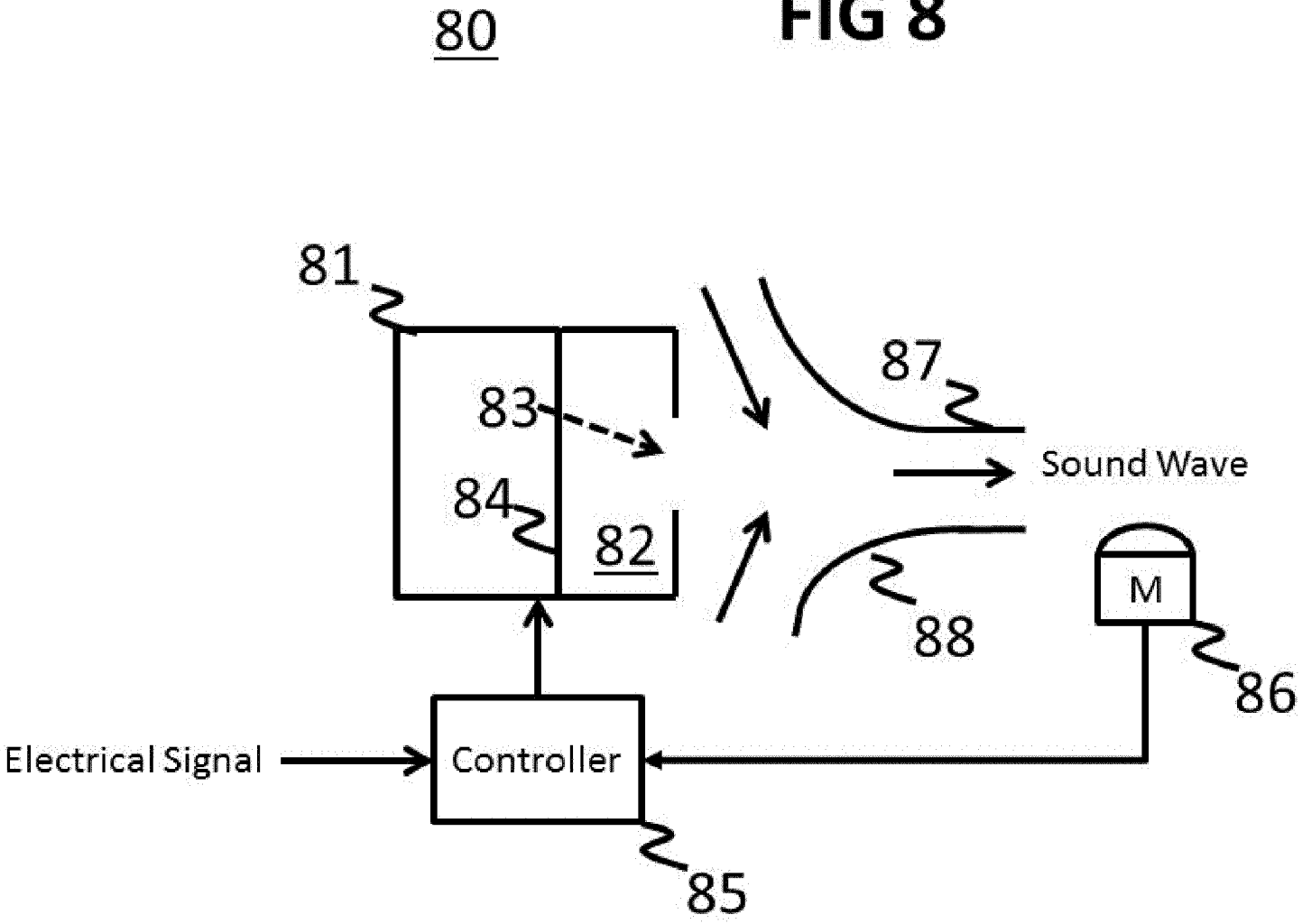
FIG. 8 depicts still another exemplary embodiment of an apparatus for producing an acoustic wave according to still another aspect of the present invention.
Figure 9:
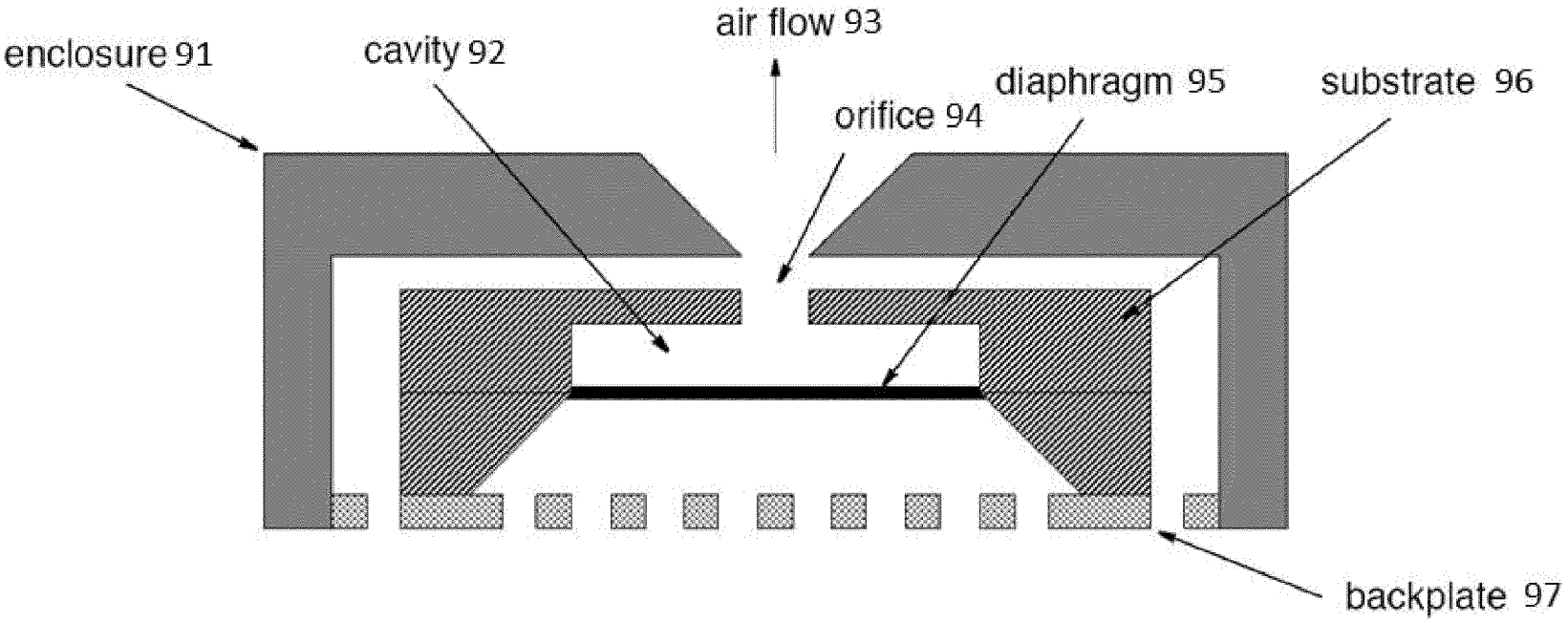
FIG. 9 depicts another exemplary embodiment of a diaphragm based apparatus for generating an acoustic wave according to another aspect of the present invention.

In lieu of using valves, it is also possible to modulate devices fluid injectors 21, 22 and 31 directly, as shown in FIGS. 4 and 5 (see elements 41, 42 and 51, respectively). Thus, FIG. 4 depicts apparatus 40 for generating sound waves using fluid injectors 41, 42 (e.g., pump, synthetic jet, etc.) in which the fluid injectors 41, 42 are modulated directly by controller 45. This is possible when fluid injector 41, 42 are capable of altering the fluid flow relative to a control signal. Examples of fluid injectors that can be controlled directly without using a valve are shown in FIGS. 7-9.

FIG. 5 depicts an apparatus 50 for producing a sound wave using a fluid injector 51 that is directly controlled by controller 55. As in FIG. 4, FIG. 5 operates as in FIG. 3 but without valve 33 because the fluid injector 51 is controlled directly by the controller 55 as in FIG. 4.

In either case, the control signal from the controller in any of the embodiments can be either an analog signal or a digital signal. If the control signal is an analog signal, the fluid flow out of the fluid injector A (e.g., 21, 31, 41 and 51) (and into fluid injector B, e.g., 22 and 42) can be proportional to the analog control signal.

If the control signal is a digital signal, the fluid flow out of fluid injector A (e.g., 21, 31, 41 and 51) (and into fluid injector B, e.g., 22 and 42) can be at predetermined discrete levels as in accordance with the discrete levels of the digital control signal. In the limit, the digital control signal can be binary, turning on and off fluid injector A (e.g., 21, 31, 41 and 51) (and fluid injector B, e.g., 22 and 42) as necessary.

Figure 1:
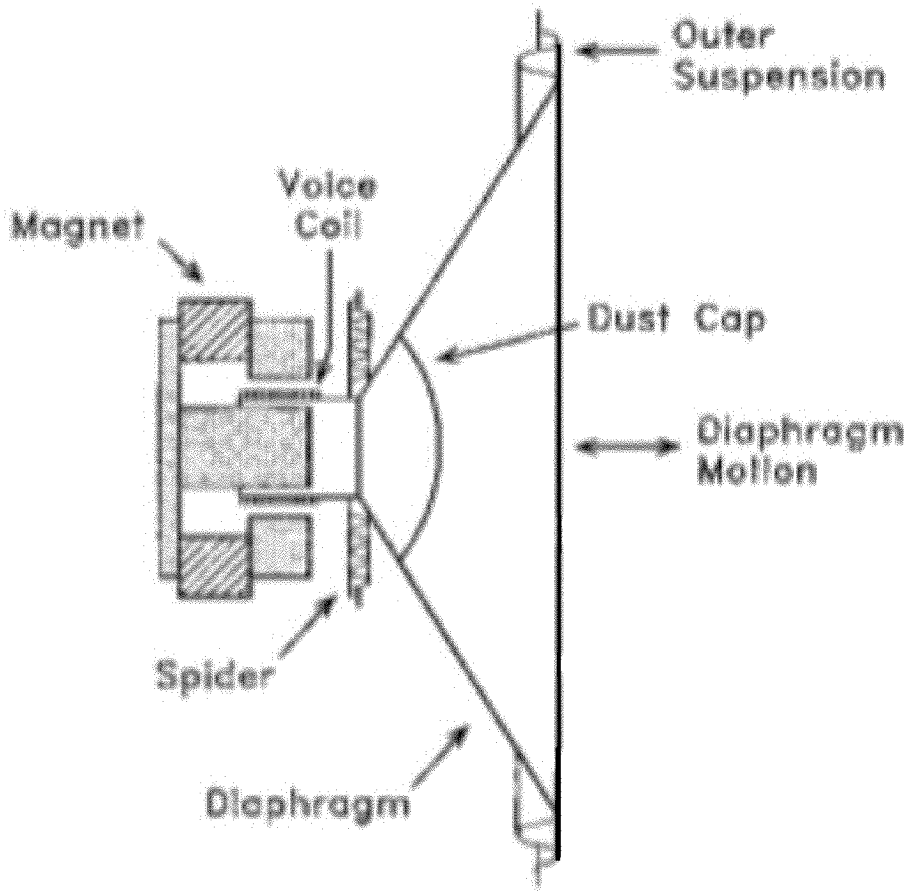
FIG. 1 depicts a prior art example of a traditional loudspeaker.

One key difference between the method of the present invention and that of the traditional methods (e.g., a conventional loudspeaker as shown in FIG. 1) is that the motion of a traditional loudspeaker diaphragm (i.e., the speed and position of the diaphragm) remains directly proportional to the acoustic wave produced. More specifically, the diaphragm in the traditional loudspeaker is constrained to move at the same speed as the frequency of the desired sound being reproduced. This design constraint limits the ability to reduce the size of the diaphragm because at a given speed of vibration, small diaphragms are only capable of producing limited acoustic power.

In contrast, in the various embodiments of the present invention set forth herein, the detailed operation of the fluid injector is decoupled from the reproduced sound. Such decoupling is possible because the generated fluid flow is able to produce the desired acoustic pressure wave without requiring any mechanical motion directly related to the frequency content of the sound wave output. The embodiments herein can be made to function in the ultrasonic range while outputting audible sound waves.

Indeed, fluid injectors need not be diaphragm-based at all; any device capable of producing fluid flow can potentially be used since the generated fluid flow can be independent of the desired acoustic wave. This decoupling of the internal operation from the reproduced sound provides the basis for the significant miniaturization advantage provided by the present invention.

For example, in some embodiments set forth herein, the fluid flow can be created by diaphragm action, which operates at the diaphragm's most efficient speed, such as at the inherent resonant frequency of the diaphragm, which speed can be independent of the reproduced sound frequency. Thus, the output sound wave is decoupled from the speed of the internal diaphragm motion.

As an example, if fluid injectors used the same size diaphragm as a similar loudspeaker to create the fluid flows, their diaphragms would be allowed to move at a much faster rate than possible when compared with a similarly-sized loudspeaker. This creates a greater flow and corresponding acoustic wave and intensity per given size. Therefore, relatively greater acoustic power is now possible at smaller sizes. Alternatively, a normal sized loudspeaker would have greater acoustic power than its traditional counterpart for the same size using the technique of the present invention.

Exemplary Embodiments

Figure 6:
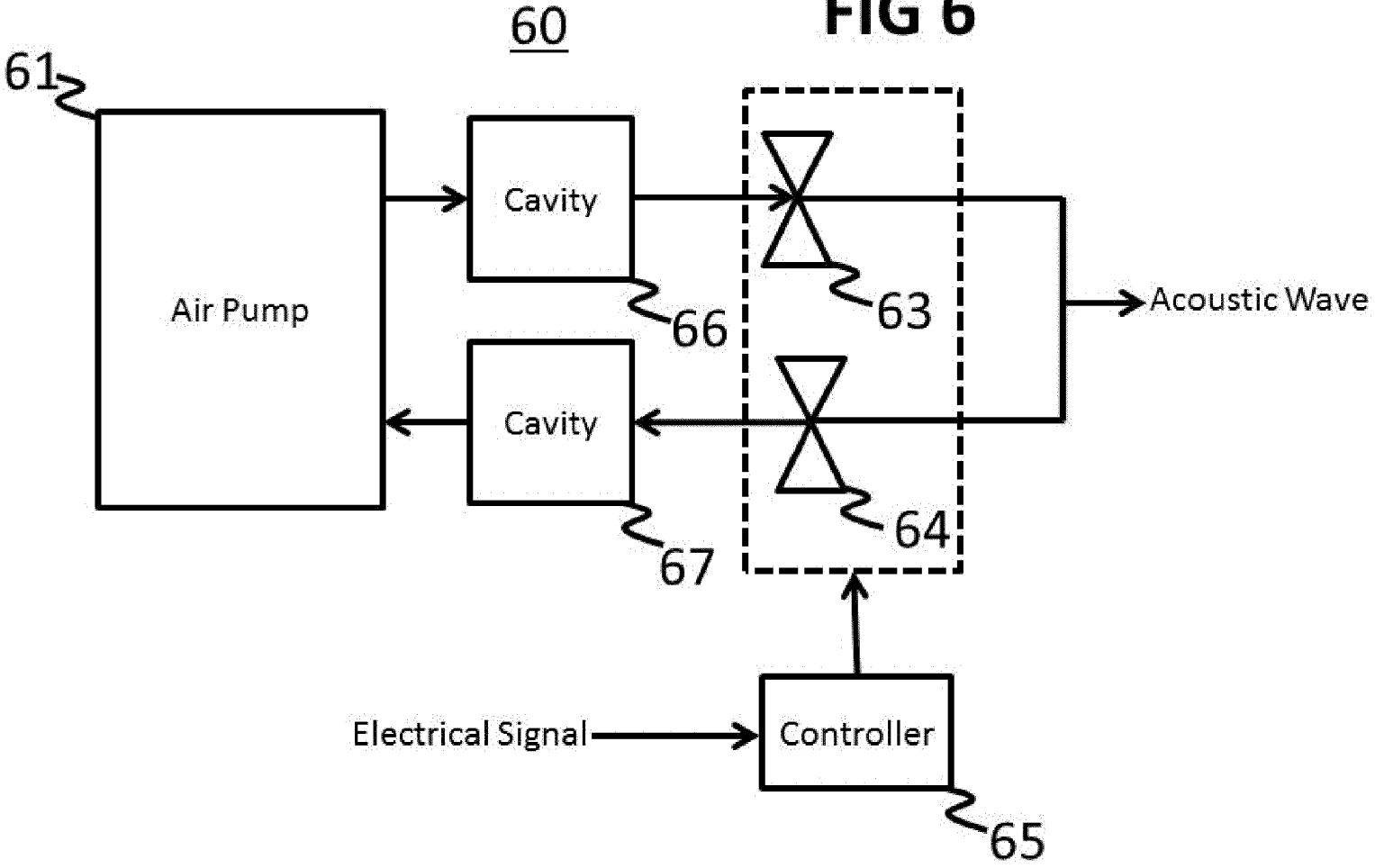
FIG. 6 depicts another exemplary embodiment of an apparatus for producing an acoustic wave according to still another aspect of the present invention.

FIG. 6 shows an exemplary embodiment 60 of a speaker or acoustic wave generator according to one aspect of the present invention. This exemplary embodiment 60 employs a fluid injector comprised of an air pump and cavity. Air pump 61 is an air pump that pumps air from cavity 67 to cavity 66, thus filling cavity 66 with compressed air and creating a vacuum in cavity 67. By turning on valve 63 using controller 65, airflow is formed in an outward direction. By turning on valve 64 using controller 65, airflow is formed in an inward direction. By doing this at an appropriate rate and according to the input electrical signal, an acoustic sound wave is generated that is dependent upon the input electrical signal but whose internal operation is not dependent on the reproduced sound.

Air pump 61 can be a micro-machined air pump as described in Chou, T.-K. A. et al., *Characterization of Micromachined Acoustic Ejector and its Applications*, The Fifteenth IEEE International Conference on Micro Electro Mechanical Systems, 2002.

Cavities 66, 67 can also be micro-machined in microelectromechanical (MEM) devices.

FIG. 7 shows a second exemplary embodiment of the present invention. Elements 76 and 77 are "valveless" diaphragm based pumps, which operate by vibration of the diaphragms 74*a*, 74*b*, respectively. When diaphragms 74*a* and 74*b* move to expand the cavities inside pump 76 and pump 77, respectively, air is drawn in through diffusers 72 and 79, respectively. When diaphragms 74*a* and 74*b* move to contract the cavities inside pump 76 and pump 77, respectively, air is forced out of nozzles 78 and 73, respectively. By vibrating to alternately expand and contract their respective cavities, pumps 76 and 77 produce airflows in the directions shown in FIG. 7. Cavity 71 forms a repository to store air pumped up by pump 77 and a source for air to supply the flow caused by pump 76. To effect compression, controller 75 turns on pump 76 to cause an airflow output and an increase in output pressure. To effect rarefaction, controller 75 turns on pump 77 to cause airflow into cavity 71 and a decrease in output pressure. In so doing, an acoustic wave is generated that relates to the electrical signal input to controller 75, but the diaphragm movement of the apparatus 70 does not vibrate at the frequencies of the acoustic wave.

FIG. 8 shows another exemplary embodiment of the present invention. Element 81 is a synthetic jet containing a vibrating diaphragm 84 inside an enclosure with a cavity 82 and an orifice 83. As the diaphragm 84 vibrates, the diaphragm alternately forces the environmental fluid into and out of the cavity 82. Typically, the fluid could be air; however, other fluids may suffice depending on the environment. Ducts 87, 88 help direct fluid flow.

If the force of the diaphragm 84 is violent enough to expel the fluid at a sufficient distance, the fluid escapes and a net positive flow is created through the process of entrainment. In other words the external fluid mixes with the output jet to become part of the jet.

By suitable control of synthetic jet 81 using controller 85 based on the input electrical signal, an acoustic wave can be produced that relates to the electrical signal.

Optionally, a sensor such as a microphone 86 can be used to pick up the sound wave produced, which sound wave is fed back to controller 85 to affect a linearization of the sound wave as related to the electrical signal. This linearization is important in the case where the sound wave produced contains distortion and does not reproduce the desired sound with sufficient fidelity. Linearization can be applied to any of the embodiments discussed herein.

Alternatively, a sensor can be used to correct only a portion of the acoustic wave if the distortion is limited to only that portion of the acoustic wave.

Returning to FIG. 5, which shows an exemplary embodiment of an acoustic wave generator based on the present invention. Here fluid injector 51 can be an air pump, and controller 55 converts the desired electrical signal into a suitable control signal that will allow air pump 51 to produce an acoustic sound wave representative of the input electrical signal.

FIG. 9 is an exemplary embodiment 90 of the air pump 51 in FIG. 5 or the air pump 81 in FIG. 8, with the exception that the perforations in the backplate are shown explicitly in FIG. 9. In FIG. 9, an air cavity 92 is formed by a diaphragm 95 and the substrate 96. In this embodiment 90, electrostatic actuation is used, so electrodes (not shown) are attached to the diaphragm 95 and the backplate 97. When a voltage is applied to the electrodes, the electrostatic force between the diaphragm 95 and the backplate 97 pulls the diaphragm 95 downward, enlarging the cavity 92 and drawing air into the cavity 92 through the orifice 94. When the applied voltage returns to zero, the diaphragm 95 is released and air is forced out through the orifice 94.

When a periodic signal is applied to the electrodes, the diaphragm 95 vibrates at the frequency of the applied signal. This creates pulses of air that escape the enclosure 91 and mix with surrounding air. Beyond several orifice-diameters from the enclosure 91, the air pulses lose their structure and meld with ambient air to form a steady stream of air flow proportional to the magnitude of the air pulses, which magnitude of air pulses is itself proportional to the peak displacement of the diaphragm 96.

Maximum air flow occurs when the applied frequency is equal to the resonant frequency of the device 90, resulting in the largest potential peak diaphragm displacement. This is a design parameter determined by the size of the cavity 92 and the diaphragm 95. A typical operating frequency can be in the ultrasonic range, such as 100 kHz. If the device 90 is micromachined, it can be very small (with dimensions on the order of centimeters, or millimeters or less). In this case, the substrate is typically made of silicon while the diaphragm 95 can be made of polyamide or similar flexible materials.

Controller

In the embodiments above, the controller controls the pump operation or diaphragm movement by supplying the voltage applied to the electrostatic actuator electrodes. The controller drives these electrodes with a periodic signal at the resonant frequency of the device. The amplitude or pulse durations of the periodic signal are modulated by the input electrical signal. The intent is to create an air flow whose amplitude is proportional to the electrical signal.

To create the desired airflow, various modulation schemes can be used. One possible modulation scheme includes amplitude modulation (AM), in which the amplitude of the applied periodic signal varies proportionally to the input electrical signal. As a result, the peak diaphragm displacements are made to vary according to the input, resulting in a proportional varying of air pulse magnitudes and air flow with the input electrical signal.

Pulse width modulation (PWM) is another way of generating the control signal. In this implementation, a pulse width modulator converts the input electrical signal into pulses at the resonant frequency whose widths are proportional to the input signal amplitude. At full pulse width, the diaphragm is able to reach maximum deflection and produces the largest air pulses and maximum airflow. At smaller input signal amplitudes, the pulse width is decreased proportionally, resulting in proportionally smaller deflections, air pulses, and airflow.

Figure 10:
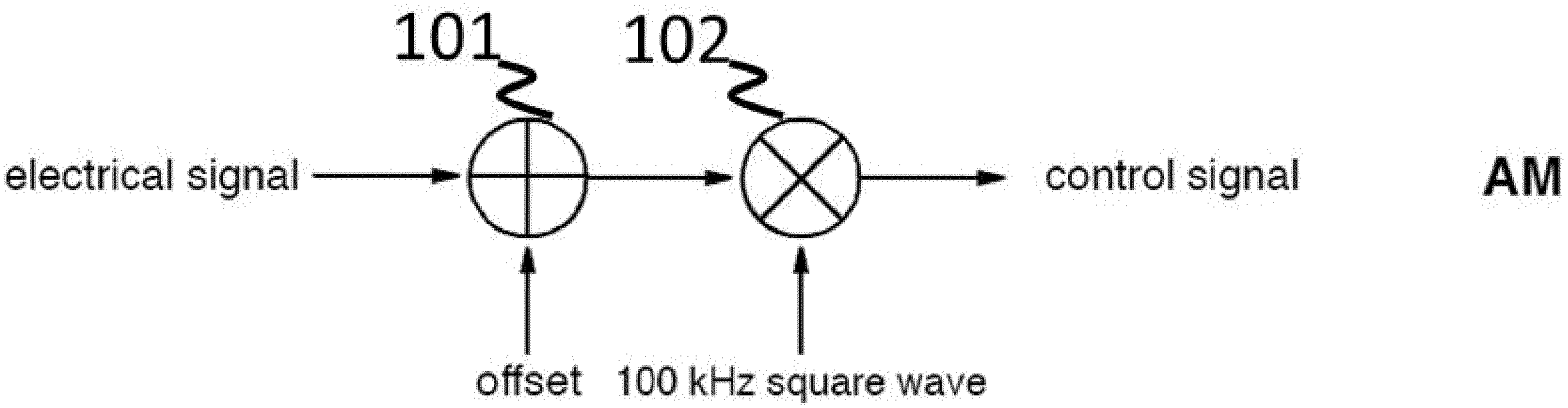
FIG. 10 depicts an exemplary embodiment of a controller for generating a control signal from an electrical signal for use in the various embodiments for producing acoustic waves according to yet another aspect of the present invention.

FIG. 10 shows an exemplary embodiment of a controller 100 according to one aspect of the present invention in which amplitude modulation is used. The frequency of operation of the actuator is at 100 kHz. An offset is added to the electrical signal by adder 101 to ensure that the input electrical signal plus the offset will always be greater than zero. This is necessary because this example device is capable of producing only positive airflow. The result from the adder 101 is then multiplied by the 100 kHz square wave to create the desired control signal, which is an amplitude modulated electrical signal with an offset.

Figure 11:
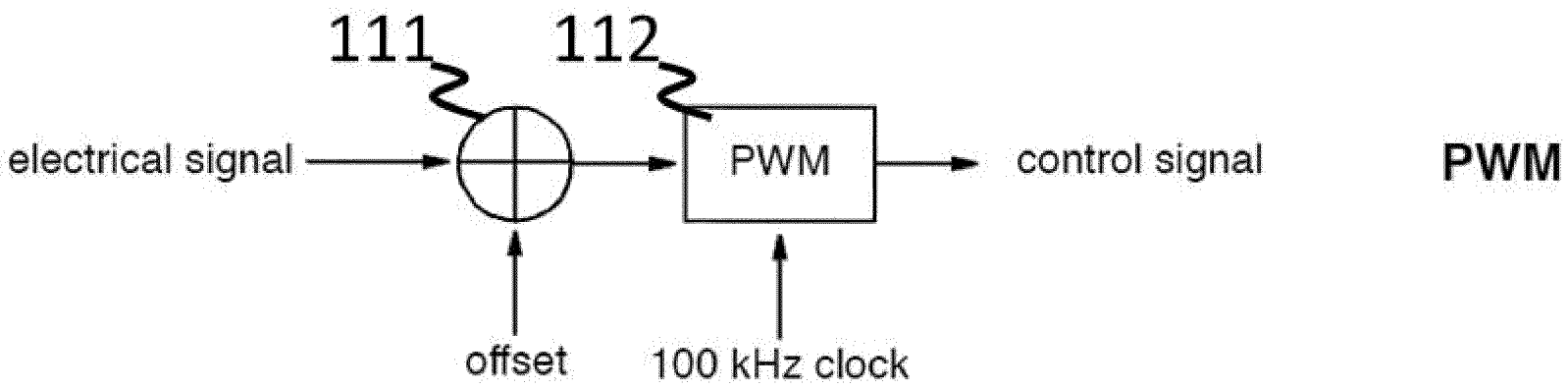
FIG. 11 depicts another exemplary embodiment of a controller for generating a control signal from an electrical signal for use in the various embodiments for producing acoustic waves according to yet another aspect of the present invention.

FIG. 11 shows an exemplary embodiment of a controller 110 according to another aspect of the present invention in which pulse width modulation is used. The frequency of operation of the actuator is at 100 kHz. An offset is added to the electrical signal by adder 110 as before to ensure that the input electrical signal plus the offset will always be greater than zero. The result from the adder 111 is then pulse width modulated at 100 kHz to create the desired control signal, which is a pulse width modulated electrical signal with an offset.

As mentioned, any of the embodiments herein can be modified to include feedback to reduce distortion. For example, as shown in FIG. 8, a microphone can be used to capture the reproduced audio. Another type of sensor could also be used to create a feedback signal useful in correcting any distortion or error in the acoustic wave.

Figure 12:
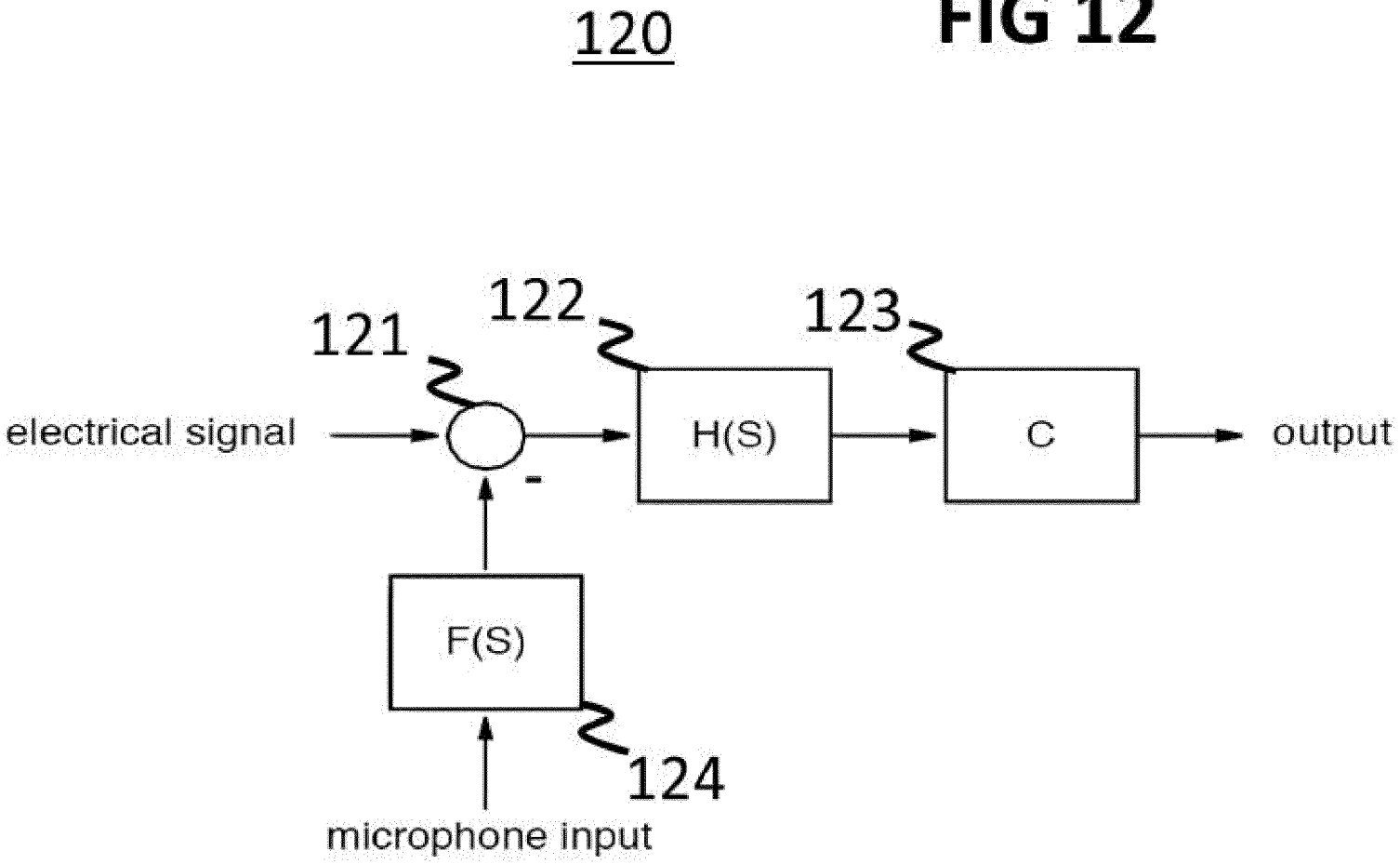
FIG. 12 depicts another exemplary embodiment of a controller for generating a control signal from an electrical signal for use in the various embodiments for producing acoustic waves according to yet another aspect of the present invention.

FIG. 12 shows an exemplary embodiment of a modified controller 120 employing feedback according to another aspect of the present invention. The output of FIG. 12 is the control signal to the fluid injector (such as shown in FIGS. 1-8). This modified controller 120 allows the frequency shaping of any error (in this instance, error refers to the difference between the acoustic wave output and the desired acoustic wave) caused by controller 123 which operates without any feedback. By using the feedback and frequency shaping, the controller 120 can adjust the input to controller 123 to achieve the desired acoustic wave.

An example of H(S) 122 and F(S) 124 includes an integrator and a constant gain, respectively. In this case, the error caused by controller 123 would be pushed mostly into the inaudible ultrasound frequency range, while the error within the audible frequency range is reduced substantially.

The above embodiments employ a fluid injector, which could include a synthetic jet, a non-zero net mass flux device, a turbine/propeller, or a pump.

Although various embodiments are specifically illustrated and described herein, it will be appreciated that modifications and variations of the invention are covered by the above teachings and within the purview of the appended claims without departing from the spirit and intended scope of the invention. For example, it is important to mention that the present description sets no limit on how the fluid injectors might be activated. Typical activation methods include piezoelectric, electrodynamic (magnetic), and electrostatic. Additionally, while the approach is suitable for MEMS, it is not a necessary condition. Finally, any linearization technique could be employed. Furthermore, these examples should not be interpreted to limit the modifications and variations of the invention covered by the claims but are merely illustrative of possible variations.

What is claimed is:

1. An apparatus for producing an acoustic wave comprising:

a fluid injector to generate the acoustic wave in response to a signal representative of a desired acoustic wave; and a controller directly modulating the fluid injector based on an electrical signal representing the desired acoustic wave, wherein the fluid injector comprises:

an enclosure having a cavity;

a diaphragm disposed inside the enclosure.

2. The apparatus according to claim 1, further comprising:

a) a first valve coupled to the fluid injector having a first control input; and b) said controller coupled to the first control input modulating the first valve based on the electrical signal representing the desired acoustic wave.

3. An apparatus for producing an acoustic wave comprising:

a fluid injector to generate the acoustic wave in response to a signal representative of a desired acoustic wave; and a controller directly modulating the fluid injector based on an electrical signal representing the desired acoustic wave, wherein the fluid injector comprises one or more synthetic jet actuators.

4. The apparatus according to claim 3, further comprising:

a) a first valve coupled to the fluid injector having a first control input; and b) a controller coupled to the first control input modulating the first valve based on an electrical signal representing a desired acoustic wave.

5. The apparatus according to claim 3, wherein each of said one or more synthetic jet actuators includes:

(i) an enclosure having a cavity and an orifice;

(ii) an electrode to receive a control signal; and (iii) a diaphragm disposed inside the enclosure, said diaphragm coupled to the control input;

wherein said a controller is to receive an electrical signal, said controller is coupled to the electrode input of the synthetic jet, said controller generates a control signal representative of the electrical signal to create the acoustic wave representative of the electrical signal, said diaphragm to force fluid into and out of the cavity as the diaphragm vibrates, said diaphragm to expel the fluid at a sufficient distance under predetermined values of the control signal to enable the fluid to escape through the orifice to create a net positive air flow through an entrainment process to create the acoustic wave.

6. An apparatus for producing an acoustic wave comprising:

a first fluid injector to produce fluid flow;

a first valve coupled to the fluid injector having a first control input; and a controller coupled to the first control input modulating the first valve based on an electrical signal representing a desired acoustic wave, further comprising:

a) said first fluid injector to produce fluid flow in a first direction outward from the apparatus;

b) a second fluid injector to produce fluid flow in a second direction inward to the apparatus and opposite to the first direction;

c) a second valve coupled to the second fluid injector and having a second control input; and e) said controller coupled to the second control input, said controller to receive the electrical signal and to activate the first and second valves using first and second control inputs, respectively, based on the electrical signal to control a fluid flow out of the first fluid injector or into the second fluid injector, thereby creating an acoustic wave representative of the electrical signal.

7. An apparatus for producing an acoustic wave comprising:

a fluid injector to generate the acoustic wave in response to a signal representative of a desired acoustic wave; and a controller directly modulating the fluid injector based on an electrical signal representing the desired acoustic wave, wherein said fluid injector comprises a first fluid injector and a second fluid injector, wherein:

a) said first fluid injector to produce fluid flow in a first direction outward from the apparatus;

b) said second fluid injector to produce fluid flow in a second direction inward to the apparatus and opposite to the first direction;

c) said first fluid injector having a first control input capable of altering a fluid flow relative to a received control signal;

d) said second fluid injector having a second control input capable of altering a fluid flow relative to said received control signal;

e) said controller coupled to the first and second control inputs, said controller to receive the electrical signal and to control a fluid flow out of the first fluid injector or into the second fluid injector.

8. An apparatus for producing an acoustic wave comprising:

a first fluid injector to produce fluid flow;

a first valve coupled to the fluid injector having a first control input; and a controller coupled to the first control input modulating the first valve based on an electrical signal representing a desired acoustic wave, wherein said first fluid injector comprises a pump and the apparatus further comprising:

a) said pump having an input and an output;

b) a first cavity having an input coupled to an output of the pump, said first cavity having an output;

c) a second cavity having an input and having an output coupled to the input of the pump;

d) said pump to pump fluid from the second cavity to the first cavity;

e) said first valve having an input coupled to an output of the first cavity; and f) a second valve having an output coupled to the input of the second cavity, said second valve having a control input to receive the control signal and having an input;

wherein said controller receives the electrical signal, said controller is coupled to the control input of the first valve, said controller is coupled to the control input of the second valve, said controller generates a control signal representative of the electrical signal, thereby creating an acoustic wave representative of the electrical signal based on fluid output from the first valve and fluid input to the second valve.

9. An apparatus for producing an acoustic wave comprising:

a fluid injector to generate the acoustic wave in response to a signal representative of a desired acoustic wave; and a controller directly modulating the fluid injector based on an electrical signal representing the desired acoustic wave, wherein said fluid injector comprises a first fluid injector and further comprising:

a) a main cavity to store a repository of fluid, said main cavity having an input and an output; and b) a second fluid injector;

wherein:

said first fluid injector comprising a first pump, said first pump including:

(i) a first cavity having an input and having an output;

(ii) a first diaphragm disposed in the first cavity;

(iii) a first diffuser having an input coupled to the output of the main cavity and having an output coupled to the input of the first cavity;

(iv) a first nozzle having an input coupled to the output of the first cavity and having an output; and (v) a first control input to receive a control signal to control a movement of the first diaphragm;

said second fluid injector comprising a second pump including:

(i) a second cavity having an input and having an output;

(ii) a second diaphragm disposed in the second cavity;

(iii) a second diffuser having an input and having an output coupled to the input of the second cavity;

(iv) a second nozzle having an input coupled to the output of the second cavity and having an output coupled to the input of the main cavity; and (v) a second control input to receive the control signal to control a movement of the second diaphragm;

wherein said controller is to receive an electrical signal, said controller is coupled to the first control input of the first pump and is coupled to the second control input of the second pump, said controller is to generate a control signal representative of the electrical signal to create the acoustic wave representative of the electrical signal based on fluid output from the first nozzle caused by movement of the first diaphragm and fluid input to the second diffuser caused by movement of the second diaphragm.

10. An apparatus for producing an acoustic wave comprising:

a fluid injector to generate the acoustic wave in response to a signal representative of a desired acoustic wave; and a controller directly modulating the fluid injector based on an electrical signal representing the desired acoustic wave, wherein the controller outputs an analog control signal, and the fluid flow out of the fluid injector is proportional to the analog control signal.

11. An apparatus for producing an acoustic wave comprising:

a first fluid injector to produce fluid flow;

a first valve coupled to the fluid injector having a first control input; and a controller coupled to the first control input modulating the first valve based on an electrical signal representing a desired acoustic wave, wherein the controller outputs an analog control signal to activate the valve, and the fluid flow out of the valve is proportional to the analog control signal.

* * * * *